US005936345A

United States Patent [19]

Hora

[11] Patent Number: 5,936,345

[45] Date of Patent: Aug. 10, 1999

[54] LEVEL CONTACT STRUCTURE FOR AN ELECTROLUMINESCENT LAMP

[75] Inventor: Takayuki Hora, Shiga, Japan

[73] Assignee: NEC Corporation, Tokyo, Japan

[21] Appl. No.: 08/929,677

[22] Filed: Sep. 15, 1997

[30] Foreign Application Priority Data

Sep. 13, 1996 [JP] Japan ..... 8-243268

[51] Int. Cl.[6] ..... H01J 1/62; H01J 63/04

[52] U.S. Cl. ..... 313/506; 313/498; 313/509; 315/169.3

[58] Field of Search ..... 313/494, 498, 313/506, 509; 427/66, 108; 315/169.3, 169.4

[56] References Cited

U.S. PATENT DOCUMENTS

| | | | |
|---|---|---|---|
| 5,258,252 | 11/1993 | Sakai et al. | 430/66 |
| 5,346,718 | 9/1994 | Thorgersen et al. | 427/66 |
| 5,483,120 | 1/1996 | Murakami | 313/506 |
| 5,491,379 | 2/1996 | Daigle et al. | 313/509 |
| 5,552,679 | 9/1996 | Murasko | 315/169.3 |
| 5,686,792 | 11/1997 | Ensign, Jr. | 313/509 |

*Primary Examiner*—Vip Patel
*Assistant Examiner*—Michael J. Smith
*Attorney, Agent, or Firm*—Young & Thompson

[57] ABSTRACT

An electroluminescent lamp conductive layer structure for contacting with a connector. The structure includes first side and second side conductive layers. The first-side conductive layer extends on an isolation layer structure over an electrode so as to be electrically isolated from the electrode by the isolation layer. The first-side conductive layer has a first contact portion which contacts the connector. The first contact portion extends over a first region of a leveled portion of the isolation layered structure. The second-side conductive layer is electrically connected to the electrode. The second-side conductive layer is spaced from the first-side conductive layer. The second-side conductive layer has a second contact portion which contacts the connector. The second contact portion extends over a second region of the same leveled portion of the isolation layer so that at least the first and second contact portions have the same level as each other. The respective layered structures between the substrate and the contact portions are identical.

7 Claims, 2 Drawing Sheets

LEVEL CONTACT STRUCTURE FOR AN ELECTROLUMINESCENT LAMP

BACKGROUND OF THE INVENTION

The present invention relates to an electroluminescent lamp, and more particularly to an electroluminescent lamp having a level electrical connection structure for receipt of power.

A conventional electroluminescent lamp will be described with reference to FIG. 1. A transparent electrode 2 is provided which extends over a top surface of a transparent substrate 1. An electroluminescent layer 3 is selectively provided on a predetermined first area of a top surface of the transparent electrode 2. A reflective insulation film 4 is provided which extends over a top surface of the electroluminescent layer 3. A first-side conductive layer 5 extends over a top surface of the reflective insulation film 4 except on a region adjacent to a boundary between the above first area and a second area opposite to the above first area. A second-side conductive layer 6 extends on the second area of the top surface of the transparent electrode 2 provided that the second-side conductive layer 6 is spaced via a small gap from the electroluminescent layer 3. The second-side conductive layer 6 is in contact with the transparent electrode 2 so that the second-side conductive layer 6 is electrically connected to the transparent electrode 2.

In use of the above electroluminescent lamp, a connector is attached on the above electroluminescent lamp, wherein the connector has pins which securely contact with the first-side and second-side conductive layers 5 and 6. Normally, such connector is a pressing type connector such as a rubber connector, pin connector or spring connector. As illustrated in FIG. 1, the first-side and second-side conductive layers 5 and 6 differ in level from each other. This causes a difference in contact pressure to the connector pins between the first-side and second-side conductive layers 5 and 6. This may cause a non-uniform electrical contact of the first-side and second-side conductive layers 5 and 6 to the connector pins. Such a non-uniform electrical contact may further cause an electrical disconnection or unstable electrical connection of the first-side and second-side conductive layers 5 and 6 to the connector pins. This makes it difficult to be certain that the above electroluminescent lamp will remain ON.

Another electroluminescent lamp will subsequently be described with reference to FIG. 2. A transparent electrode 2 is provided which extends over a top surface of a transparent substrate 1. An electroluminescent layer 3 is selectively provided on a predetermined first area of a top surface of the transparent electrode 2. A reflective insulation film 4 extends over a top surface of the electroluminescent layer 3. A first-side conductive layer 5 extends over a top surface of the reflective insulation film 4 except on a side region adjacent to a boundary between the above first area and a second area opposite to the above first area. An insulation layer 8 extends on the above side region of the reflective insulation film 4 and the first-side conductive layer 5 but only on a region relatively near the above side region of the reflective insulation film 4. A second-side conductive layer 6 extends on the second area of the top surface of the transparent electrode 2 and over the insulation layer 8 so that the second-side conductive layer 6 is isolated by the insulation layer 8 from the first-side conductive layer 5.

In use of the above electroluminescent lamp, a connector is attached on the above electroluminescent lamp, wherein the connector has pins which securely contact with the first-side and second-side conductive layers 5 and 6. Normally, such a connector is a pressing type connector such as a rubber connector, pin connector or spring connector. As well illustrated in FIG. 2, however, the first-side and second-side conductive layers 5 and 6 differ in level from each other. This causes a difference in contact pressure to the connector pins between the first-side and second-side conductive layers 5 and 6. This may cause a non-uniform electrical contact of the first-side and second-side conductive layers 5 and 6 to the connector pins. Such a non-uniform electrical contact may further cause an electrical disconnection or unstable electrical connection of the first-side and second-side conductive layers 5 and 6 from the connector pins. This makes it difficult to be certain that the above electroluminescent lamp will remain ON.

Furthermore, as described above and illustrated in FIG. 2, the second-side conductive layer 6 is provided on the insulation layer 8 whilst the first-side conductive layer 5 is provided on the reflective insulation film 4. The insulation layer 8 serves as a base layer for the second-side conductive layer 6 whilst the reflective insulation film 4 serves as a base layer for the first-side conductive layer 5. The insulation layer 8 and the reflective insulation film 4 largely differ from each other in material, structure, strength and elasticity, for which reason when the connector pins are pressing the first-side and second-side conductive layers 5 and 6, the insulation layer 8 and the reflective insulation film 4 are deformed. Those deformations of the insulation layer 8 and the reflective insulation film 4 may cause non-uniform contact pressure of the contact pins on the first-side and second-side conductive layers 5 and 6. This may cause a non-uniform electrical contact of the first-side and second-side conductive layers 5 and 6 to the connector pins. Such a non-uniform electrical contact may further cause an electrical disconnection or unstable electrical connection of the first-side and second-side conductive layers 5 and 6 from the connector pins. This makes it difficult to be certain that the above electroluminescent lamp will remain ON.

In the above circumstances, it had been required to develop a novel electroluminescent lamp which has substantially no difference in contact pressure between the connector pins and the first-side and second-side conductive layers provided in the electroluminescent lamp.

SUMMARY OF THE INVENTION

Accordingly, it is an object of the present invention to provide a novel electroluminescent lamp free from the above problems or disadvantages.

It is a further object of the present invention to provide a novel electroluminescent lamp which has substantially no difference in contact pressure between connector pins and the first-side and second-side conductive layers provided in the electroluminescent lamp.

It is a further more object of the present invention to provide a novel electroluminescent lamp which enables a uniform and secure electrical contact of the first-side and second-side conductive layers to the connector pins.

The above and other objects, features and advantages of the present invention will be apparent from the following description.

The present invention provides an electroluminescent lamp conductive layer structure for contacting with a connector. The structure comprises first side and second side conductive layers. The first-side conductive layer extends on an isolation layered structure over an electrode so as to be electrically isolated from the electrode by the isolation layer.

The first-side conductive layer has a first contact portion which contacts the connector. The first contact portion extends over a first region of leveled portion of the isolation layered structure. The second-side conductive layer is electrically connected to the electrode. The second-side conductive layer is spaced from the first-side conductive layer. The second-side conductive layer has a second contact portion which contacts the connector. The second contact portion extends over a second region of the leveled portion so that at least the first and second contact portions have the same level as each other.

As described above, the first-side and second-side conductive layers have the same level as each other. This avoids a difference in contact pressure between the connector pins and the first-side and second-side conductive layers. This allows a uniform electrical contact of the first-side and second-side conductive layers to the connector pins. Such a uniform electrical contact prevents electrical disconnection and unstable electrical connection of the first-side and second-side conductive layers to the connector pins. This means that the above electroluminescent lamp will remain ON when turned ON.

BRIEF DESCRIPTION OF THE DRAWINGS

Preferred embodiments according to the present invention will be described in detail with reference to the accompanying drawings.

DETAILED DISCLOSURE OF THE INVENTION

Figure 1:
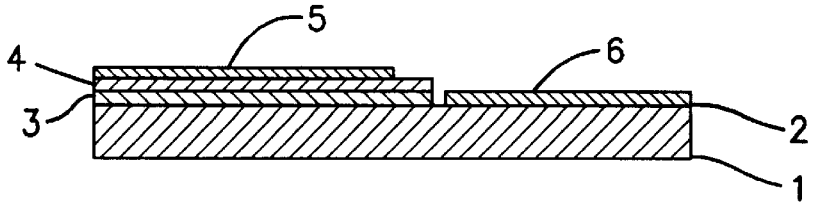
FIG. 1 PRIOR ART
FIG. 1 is a fragmentary cross sectional elevation view illustrative of the first conventional electroluminescent lamp.
Figure 2:
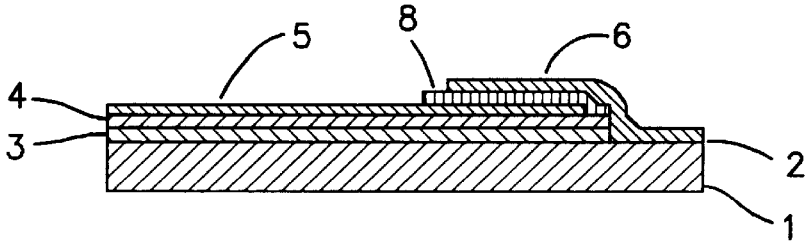
FIG. 2 PRIOR ART
FIG. 2 is a fragmentary cross sectional elevation view illustrative of the second conventional electroluminescent lamp.

The present invention provides an electroluminescent lamp conductive layer structure for contacting with a connector. The structure comprises first side and second side conductive layers. The first-side conductive layer extends on an isolation layer structure over an electrode so as to be electrically isolated from the electrode by the isolation layer. The first-side conductive layer has a first contact portion which contacts the connector. The first contact portion extends over a first region of a leveled portion of the isolation layer structure. The second-side conductive layer is electrically connected to the electrode. The second-side conductive layer is spaced from the first-side conductive layer. The second-side conductive layer has a second contact portion which contacts the connector. The second contact portion extends over a second region of the leveled portion so that at least the first and second contact portions have the same level as each other.

As described above, the first-side and second-side conductive layers have the same level as each other. Thus, there is no difference in contact pressure between the connector pins and the first-side and second-side conductive layers. This allows a uniform electrical contact of the first-side and second-side conductive layers to the connector pins. Such a uniform electrical contact prevents electrical disconnection and unstable electrical connection of the first-side and second-side conductive layers to the connector pins. This results in an increased certainty that the above electroluminescent lamp will remain ON when turned ON.

It is preferable that the first-side and second-side conductive layers have the same thickness. It is also preferable that the first-side and second-side conductive layers are made of the same material. This arrangement further decreases the difference in contact pressure to the connector pins between the first-side and second-side conductive layers.

It is also preferable that the isolation layered structure comprises an electroluminescent layer selectively extending over the electrode except for a side region thereof, and a reflective isolation layer extending over the electroluminescent layer, where the reflective isolation layer is entirely leveled to have first and second regions. The second-side conductive layer extends over the side region of the electrode and the second region of the reflective isolation layer whilst the first-side conductive layer extends over the first region of the reflective isolation layer.

It is also preferable that the isolation layered structure comprises an electroluminescent layer selectively extending over the electrode except for a side region thereof, a reflective isolation layer extending over the electroluminescent layer, and a soft resin layer made of a soft resin which extends over at least a part of the reflective isolation layer, where the soft resin layer is entirely leveled to have first and second leveled regions. The second-side conductive layer extends over the side region of the electrode and the second region of the soft resin layer whilst the first-side conductive layer extends over the reflective isolation layer and the soft resin layer. The provision of the soft resin layer is suitable for the use of the rubber connector which needs the softening or elasticity of the base layers on which the first-side and second-side conductive layers are formed. It is also preferable that the soft resin is one selected from the group consisting of polyester, vinyl and urethane.

It is also preferable that the isolation layered structure comprises an electroluminescent layer selectively extending over the electrode except for aside region thereof, a reflective isolation layer extending over the electroluminescent layer, and a hard resin layer made of a hard resin which extends over at least a part of the reflective isolation layer, where the hard resin layer is entirely leveled to have first and second leveled regions. The second-side conductive layer extends over the side region of the electrode and the second region of the hard resin layer whilst the first-side conductive layer extends over the reflective isolation layer and the hard resin layer. The provision of the hard resin layer is suitable for the use of the pin connector which needs the rigidity of the base lays on which the first-side and second-side conductive layers are formed. It is also preferable that the hard resin is one selected from the group consisting of epoxyacrylate, phenol reins, urea resins, and melamine resins.

The present invention also provides an electroluminescent lamp conductive layer structure for contacting with a connector. The structure comprises first-side and second-side conductive layers. The first-side conductive layer extends on an isolation layer structure over an electrode so as to be electrically isolated from the electrode by the isolation layer. The first-side conductive layer has a first contact portion which contacts the connector. The first contact portion extends over a first region of the isolation layer structure. The second-side conductive layer is spaced from the first-side conductive layer. The second-side conductive layer has a second contact portion which contacts the connector. The second contact portion extends over a second region of the isolation layered structure so that top surfaces of the first and second contact portions have the same level as each other.

It is preferable that the first and second regions of the isolation layered structure have the same level and that the first-side and second-side conductive layers have the same thickness. It is also preferable that the first-side and second-side conductive layers are made of the same material.

It is also preferable that the first and second regions of the isolation layered structure have different levels from each other and the first-side and second-side conductive layers have different thicknesses from each other by a difference in level between the first and second regions so that the top surfaces of the first and second contact portions have the same level as each other.

It is also preferable that the isolation layered structure comprises an electroluminescent layer selectively extending over the electrode except for a side region thereof, and a reflective isolation layer extending over the electroluminescent layer, where the reflective isolation layer is entirely leveled to have first and second regions of the leveled portion. The second-side conductive layer extends over the side region of the electrode and the second region of the reflective isolation layer whilst the first-side conductive layer extends over the first region of the reflective isolation layer.

It is also preferable that the isolation layer structure comprises an electroluminescent layer selectively extending over the electrode except for a side region thereof, a reflective isolation layer extending over the electroluminescent layer, and a soft resin layer made of a soft resin which extends over at least a part of the reflective isolation layer where the soft resin layer is entirely leveled to have first and second regions. The second-side conductive layer extends over the side region of the electrode and the second region of the soft resin layer whilst the first-side conductive layer extends over the reflective isolation layer and the soft resin layer. The provision of the soft resin layer is suitable for the use of the rubber connector which needs the softening or elasticity of the base layers on which the first-side and second-side conductive layers are formed. It is also preferable that the soft resin is one selected from the group consisting of polyester, vinyl and urethane.

It is also preferable that the isolation layered structure comprises an electroluminescent layer selectively extending over the electrode except for a side region thereof, a reflective isolation layer extending over the electroluminescent layer, and a hard resin layer made of a hard resin which extends over at least a part of the reflective isolation layer where the hard resin layer is entirely leveled to have first and second regions. The second-side conductive layer extends over the side region of the electrode and the second region of the hard resin layer whilst the first-side conductive layer extends over the reflective isolation layer and the hard resin layer. The provision of the hard resin layer is suitable for the use of the pin connector which needs the rigidity of the base layers on which the first-side and second-side conductive layers are formed. It is also preferable that the hard resin is one selected from the group consisting of epoxyacrylate, phenol resins, urea resins, and melamine resins.

The present invention also provides an electroluminescent lamp comprising a transparent substrate, a transparent electrode extending over the transparent substrate, an electroluminescent layer selectively extending over the electrode except for a side region thereof, and a reflective isolation layer extending over the electroluminescent layer, and first-side and second-side conductive layers. The first-side conductive layer extends over the reflective isolation layer. The first-side conductive layer has a first contact portion which contacts the connector. The first contact portion extends over a first region of a leveled portion of the reflective isolation layer. The second-side conductive layer extends over the side region of the electrode and a second region of the reflective isolation layer. The second-side conductive layer is spaced from the first-side conductive layer. The second-side conductive layer has a second contact portion which contacts the connector. The second contact portion extends over a second region of the leveled portion so that at least the first and second contact portions have the same level as each other.

The present invention also provides an electroluminescent lamp comprising a transparent substrate, a transparent electrode extending over the transparent substrate, an electroluminescent layer selectively extending over the electrode except for a side region thereof, and a reflective isolation layer extending over the electroluminescent layer, a soft resin layer made of a soft region which extends over at least a part of the reflective isolation layer where the soft resin layer is entirely leveled to have first and second leveled regions, and first-side and second side conductive layers. The first-side conductive layer extends over the reflective isolation layer and the soft resin layer. The first-side conductive layer has a first contact portion which contacts the connector. The first contact portion extends over a first region of the soft resin layer. The second-side conductive layer extends over the side region of the electrode and a second region of the soft resin layer. The second-side conductive layer is spaced from the first-side conductive layer. The second-side conductive layer has a second contact portion which contacts the connector so that at least the first and second contact portions have the same level as each other.

The present invention also provides an electroluminescent lamp comprising a transparent substrate, a transparent electrode extending over the transparent substrate, an electroluminescent layer selectively extending over the electrode except for a side region thereof, and a reflective isolation layer extending over the electroluminescent layer, a hard resin layer made of a hard resin which extends over at least a part of the reflective isolation layer where the hard resin layer is entirely leveled to have first and second leveled regions, and first-side and second-side conductive layers. The first-side conductive layer extends over the reflective isolation layer and the hard resin layer. The first-side conductive layer extends over the reflective isolation layer and the hard resin layer. The first-side conductive layer extends over the reflective isolation layer and the hard resin layer. The first-side conductive layer has a first contact portion which contacts the connector. The first contact portion extends over a first region of the hard resin layer. The second-side conductive layer extends over the side region of the electrode and a second region of the hard resin layer. The second-side conductive layer is spaced from the first-side conductive layer. The second-side conductive layer has a second contact portion which contacts the connector so that at least the first and second contact portions have the same level as each other.

Figure 3:
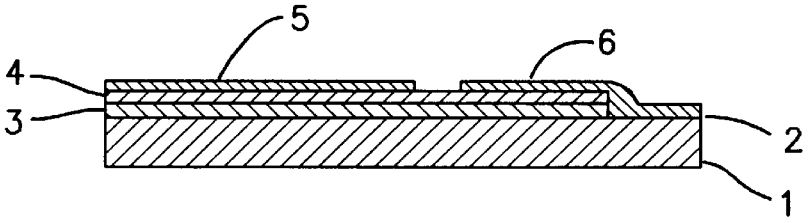
FIG. 3 is a fragmentary cross sectional elevation view illustrative of a novel electroluminescent lamp in a first embodiment according to the present invention.

A first embodiment according to the present invention will be described with reference to FIGS. 3 and 4. An electroluminescent lamp is formed on a transparent substrate 1. The transparent substrate 1 may be made of PET film. A transparent electrode 2 is provided which extends over the transparent substrate 1. The transparent electrode 2 may be made of indium tin oxide. The transparent electrode 2 may be coated on the transparent substrate 1 by a vacuum evaporation or a sputtering method. An electroluminescent layer 3 is provided which selectively extends over the transparent electrode 2 except for a side region thereof. The electroluminescent layer 3 may be formed by a screen printing method. The electroluminescent layer 3 may comprise an organic resin or a fluorine resin into which luminescent particles are dispersed. The fluorine resins may be fluorine rubbers. The organic resin may be cyanoethylpullulan and cyanoethylcellulose. The luminescent particles may comprise ZnS:Cu which is moisture-proof coated with alumina or silica. A reflective isolation layer 4 is provided which extends over the electroluminescent layer 3. The reflective isolation layer 4 may be formed by the same method as used in forming the electroluminescent layer 3. The reflective isolation layer 4 may comprise an organic resin or a fluorine resin into which dielectric powders are dispersed. The dielectric powders may be barium titanate. The fluorine resins may be fluorine rubbers. The organic resin may be cyanotehylpullulan and cyanoetrylcellulose. A first-side conductive layer 5 is provided which selectively extends over a first region of the reflective isolation layer 4. The first-side conductive layer 5 may be formed by a screening printing method. Electroluminescence appears in the same pattern as the first-side conductive layer 5. A pin of the connector is in contact with and presses a part of the first-side conductive layer 5 so that the first-side conductive layer 5 is electrically connected to an external power source. A second-side conductive layer 6 is provided which extends over the side region of the transparent electrode 2 and a second region of the reflective isolation layer 4. The second-side conductive layer 6 is spaced from the first-side conductive layer 5. The second-side conductive layer 6 is spaced from the first-side conductive layer 5. The second-side conductive layer 6 is in contact with the transparent electrode 2. A pin of the connector is in contact with and presses a part of the second-side conductive layer 6 so that the second-side conductive layer 6 is electrically connected to an external power source. The first-side and second-side conductive layers 5 and 6 are made of paste of silver or carbon so that the first-side and second-side conductive layers 5 and 6 are concurrently formed to have the same thickness and to be made of the same conductive material.

As described above, the first-side and second-side conductive layers 5 and 6 have the same level as each other. This causes no difference in contact pressure between the connector pins and the first-side and second-side conductive layers 5 and 6. This allows a uniform electrical contact of the first-side and second-side conductive layers 5 and 6 to the connector pins. Such a uniform electrical contact prevents electrical disconnection or an unstable electrical connection of the first-side and second-side conductive layers 5 and 6 from the connector pins so that the lamp will remain ON when turned ON.

Figure 4:
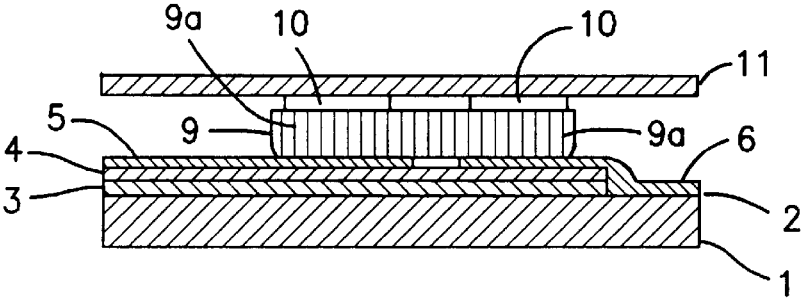
FIG. 4 is a fragmentary cross sectional elevation view illustrative of a novel electroluminescent lamp attached with a rubber connector and a printed board in a first embodiment according to the present invention.

Further, as illustrated in FIG. 4, a rubber connector 9 may be attached to the above electroluminescent lamp. The rubber connector 9 extends over the first-side and second-side conductive layers 5 and 6. Lands 10 are placed on the rubber connector 9. The lands 10 are electrically connected to the power source. The lands 10 are mounted on a printed board 11. When the printed board 11 are pressed toward the electroluminescent lamp, the lands 10 contact top portions of pins 9*a* of the rubber connector 9. The first-side and second-side conductive layers 5 and 6 have the same level and the reflective insulation layer 4 has a uniform thickness, for which reason the pins 9*a* of the rubber connector 9 are uniformly pressed to and contact with the first-side and second-side conductive layers 5 and 6.

Figure 5:
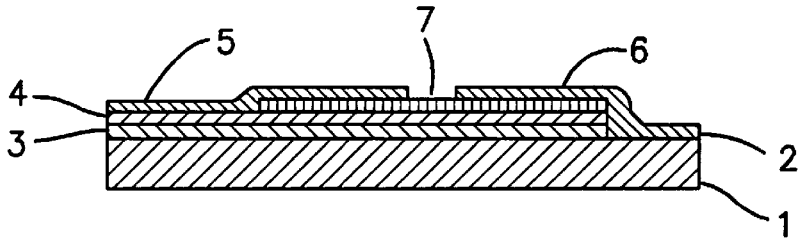
FIG. 5 is a fragmentary cross sectional elevation view illustrative of a novel electroluminescent lamp in a second embodiment according to the present invention.

A second embodiment according to the present invention will be described with reference to FIG. 5 in which similar elements use the same numerical designators as the first embodiment. A soft resin layer 7 is provided which selectively extends on the reflective insulation layer 4. The soft resin layer 7 may be formed by a screen printing method. A first-side conductive layer 5 is provided which selectively extends over the reflective isolation layer 4 and a first region of the soft resin layer 7. The first-side conductive layer 5 may be formed by a screening printing method. Electroluminescence appears in the same pattern as the first-side conductive layer 5. A pin of the connector is in contact with and presses a part of the first-side conductive layer 5 so that the first-side conductive layer 5 is electrically connected to an external power source. A second-side conductive layer 6 extends over the side region of the transparent electrode 2 and a second region of the soft resin layer 7. The second-side conductive layer 6 is spaced from the first-side conductive layer 5. The second-side conductive layer 6 is in contact with the transparent electrode 2. A pin of the connector is in contact with and presses a part of the second-side conductive layer 6 so that the second-side conductive layer 6 is electrically connected to an external power source. The first-side and second-side conductive layers 5 and 6 are made of paste of silver or carbon so that the first-side and second-side conductive layers 5 and 6 are concurrently formed to have the same thickness and to be made of the same conductive material. The provision of the soft resin layer 7 is suitable for the use of a rubber connector which needs the softening or elasticity of the base layers on which the first-side and second-side conductive layers 5 and 6 are formed. The soft resin may be polyester, vinyl or urethane.

Figure 6:
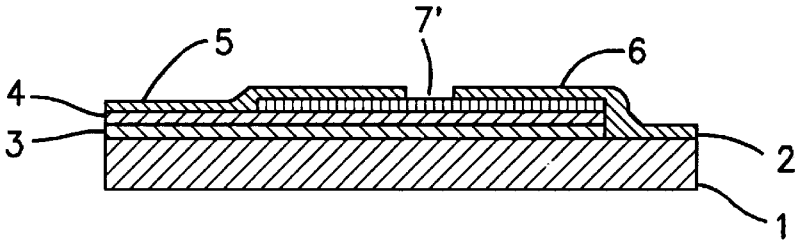
FIG. 6 is a fragmentary cross sectional elevation view illustrative of a novel electroluminescent lamp in a third embodiment according to the present invention.
Figure 7:
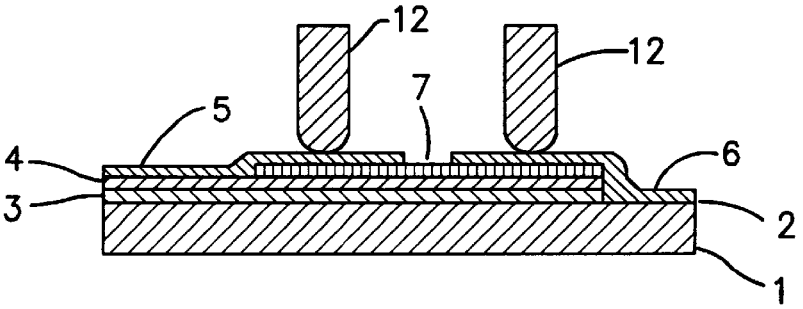
FIG. 7 is a fragmentary cross sectional elevation view illustrative of a novel electroluminescent lamp contacted with connector pins in the third embodiment according to the present invention.

In a third embodiment of the present invention shown in FIGS. 6 and 7, a hard resin layer 7' is provided which selectively extends on the reflective insulation layer 4. The hard resin layer 7' may be formed by a screen printing method. A first-side conductive layer 5 is provided which selectively extends over the reflective isolation layer 4 and a first region of the hard resin layer 7'. The first-side conductive layer 5 may be formed by a screening printing method. Electroluminescence appears in the same pattern as the first-side conductive layer 5. A pin of the connector is in contact with and presses a part of the first-side conductive layer 5 so that the first-side conductive layer 5 is electrically connected to an external power source. A second-side conductive layer 6 extends over the side region of the transparent electrode 2 and a second region of the hard resin layer 7. The provision of the hard resin layer 7' is suitable for the use of a rubber connector which needs the hardening or elasticity of the base layers on which the first-side and second-side conductive layers 5 and 6 are formed. The hard resin may be polyester, vinyl or urethane.

As illustrated in FIG. 7, a pin connector 12 is attached on the above electroluminescent lamp. The pin connector 12 has two pins which contact the first-side and second-side conductive layers 5 and 6 respectively. When the pin connector 12 is pressed toward the electroluminescent lamp, the two pins are uniformly pressed to and contact with the first-side and second-side conductive layers 5 and 6. This avoids a difference in contact pressure between the connector pins and the first-side and second-side conductive layers 5 and 6. This allows uniform electrical contact of the first-side and second-side conductive layers 5 and 6 to the connector pins. Such a uniform electrical contact prevents electrical disconnection and unstable electrical connection of the first-side and second-side conductive layers 5 and 6 to the connector pins so that the lamp remains ON when turned ON.

Whereas modifications of the present invention will be apparent to a person having ordinary skill in the art, to which the invention pertains, it is to be understood that embodiments as shown and described by way of illustrations are by no means intended to be considered in a limiting sense. Accordingly, it is to be intended to cover by claims all modifications which fall within the spirit and scope of the present invention.

What is claimed is:

1. A conductive layer structure for an electroluminescent lamp comprising:

an electroluminescent layer which is on an electrode which is on a substrate;

an isolation layer on said electroluminescent layer, said isolation layer having a generally planar first surface opposite a second surface which faces said electroluminescent layer;

a first side conductive layer having a contact portion on a first part of said planar first surface of said isolation layer; and a second side conductive layer having a contact portion on a second part of said planar first surface of said isolation layer so that said first and second side conductive layer contact portions are at the same level, said second side conductive layer being spaced from said first side conductive layer and extending on and into electrical contact with a part of said electrode not having said electroluminescent layer thereon, wherein respective layered structures directly between said substrate and each of said first and second side conductive layer contact portions are identical so that the respective layered structures respond the same to a contact pressure applied thereto.

2. The structure of claim 1, further comprising a resin layer directly between said isolation layer and said first and second side conductive layer contact portions.

3. The structure of claim 2, wherein said resin layers comprises a resin selected from a group consisting of polyester, vinyl and urethane.

4. The structure of claim 2, wherein said resin layers comprises a resin selected from a group consisting of epoxyacrylate, phenol resin, urea resin, and melamine resin.

5. The structure of claim 1, wherein said first and second side conductive layers have the same thickness.

6. The structure of claim 1, wherein said first and second side conductive layers comprise the same type of conductive material.

7. The structure of claim 1, wherein said isolation layer and said electroluminescent layer have at least one coextensive edge, and wherein said second side conductive layer has an edge portion on the coextensive edge which connects the contact portion to a portion of the second side conductive layer which extends onto the electrode.

* * * * *